United States Patent [19]

Radtke et al.

[11] 4,448,748

[45] May 15, 1984

[54] ZINC-ALUMINUM ALLOYS AND COATINGS

[75] Inventors: Schrade F. Radtke, New Canaan, Conn.; Dimitri Coutsouradis, Liege; Jacques Pelerin, Angleur, both of Belgium

[73] Assignee: International Lead Zinc Research Organization, Inc., New York, N.Y.

[21] Appl. No.: 404,405

[22] Filed: Aug. 2, 1982

Related U.S. Application Data

[62] Division of Ser. No. 245,172, Mar. 18, 1981, abandoned.

[30] Foreign Application Priority Data

Mar. 25, 1980 [BE] Belgium ..... 882431
Jan. 16, 1981 [BE] Belgium ..... 887121

[51] Int. Cl.[3] ..... C22C 18/04

[52] U.S. Cl. ..... 420/514; 420/520; 420/515; 420/516; 420/517; 420/518; 420/519; 420/416; 428/659; 427/433

[58] Field of Search ..... 420/513, 514, 515, 516, 420/518, 519, 416, 517; 428/659, 658; 427/433

[56] References Cited

U.S. PATENT DOCUMENTS

| | | | |
|---|---|---|---|
| 3,360,366 | 12/1967 | Bonis | 420/513 |
| 3,383,297 | 5/1968 | Eberius | 420/513 X |
| 4,029,478 | 6/1977 | Lee | 428/659 |
| 4,056,366 | 11/1977 | Lee et al. | 420/514 X |
| 4,128,676 | 12/1978 | Lee | 420/516 X |
| 4,152,472 | 5/1979 | Ohbu et al. | 428/659 X |

*Primary Examiner*—Brian E. Hearn
*Assistant Examiner*—David A. Hey
*Attorney, Agent, or Firm*—Brumbaugh, Graves, Donohue & Raymond

[57] ABSTRACT

There is disclosed an alloy for use in a zinc galvanizing bath comprising zinc, aluminum and a rare earth-containing alloy such as mischmetal. According to the preferred embodiments, the alloy contains from about 85% to about 97% zinc, from about 3% to about 15% aluminum and from about 5 ppm to about 1.0% mischmetal. The alloy may also contain one or more of the elements Fe, Pb, Sb, Mg, Sn, Cu and Si.

25 Claims, No Drawings

ZINC-ALUMINUM ALLOYS AND COATINGS

This application is a division of U.S. application Ser. No. 245,172, filed Mar. 18, 1981, now abandoned.

TECHNICAL FIELD

The present invention is directed to the application of zinc coatings to a substrate—commonly sheet steel.

The use of zinc as a protective coating has been known for many years. In this regard, hot dip galvanizing, either continuous or batch type, has long been used for a variety of steel products to protect the products from corrosion.

BACKGROUND ART

In order to obtain increased corrosion protection as well as other advantages (e.g. better sacrificial protection of steel; improved formability, weldability and paintability) efforts have been undertaken in the field of zinc coatings to develop improved zinc alloys for the continuous or batch application to substrates. Studies carried out in this direction have resulted in the development of new types of coatings such as the alloy Zn-55 Al-1.5Si and other zinc alloys having low (i.e., less than 15%) Al-1.5Si content. The Zn-55 Al alloy coating developed by Bethlehem Steel (see for example U.S. Pat. Nos. 3,343,930 and 3,393,089) reportedly exhibits a good corrosion resistance but, in view of its high aluminum content does not provide a satisfactory sacrificial protection of the steel substrate.

Subsequent studies have been aimed at modifying the composition of molten metal baths in order to form (by hot-dipping) a coating which improves corrosion resistance even in the most varied environments. One of the aspects of these studies was the influence of the preparation of the surface to be coated on the quality of the product obtained. It thus appears that in order to ensure a quality coating, some of the alloy coatings previously developed required expensive preliminary surface treatments involving expensive equipment. For example, this was the case with respect to zinc coatings containing typically about 5% Al and additions of other elements such as Sb, Pb+Mg, and Pb+Mg+Cu proposed by Inland Steel (see for example Inland U.S. Pat. Nos. 4,029,478 and 4,056,366 as well as U.S. Pat. No. 4,152,472 assigned to Nippon Steel). There exists evidence showing that compositions of these types are characterized by a pronounced tendency to form barespots and similar defects even in the presence of careful surface preparation.

In view of the above considerations, there continues a need for a hot-dip metal bath of such composition that no special or expensive surface preparation of the substrate would be necessary and such that the protective coating obtained thereby is substantially free of bare spots or other defects.

DISCLOSURE OF THE INVENTION

Consistent with the above, there have been developed according to the present invention zinc-containing hot-dip metal baths which yield high quality protective coatings free of defects such as bare spots. Stated generally, the bath compositions and resultant coatings constitute improvements over known alloy baths and coatings in that they contain additionally mixtures of rare earth elements. More particularly, the present invention is directed to zinc-aluminum compositions or alloys which have added thereto rare earths in the form of mischmetal. In this regard, it is preferred that the zinc-aluminum alloys be what are commonly referred to as low aluminum zinc alloys which are generally recognized to contain from about 3% to about 15% aluminum.

DETAILED DESCRIPTION

The hot-dip metal baths according to the present invention, and hence the coatings obtained therefrom, may vary considerably just as known zinc-aluminum baths and coatings may vary. In each instance, however, it is essential that the bath have added thereto a mischmetal alloy in an amount sufficient to yield the improved results observed and described herein. A mischmetal addition to a zinc-aluminum bath in the range of from about 5 ppm to about 1.0%, and preferably about 0.01% to about 0.1% (by weight), is generally contemplated as being sufficient in this regard.

As will be understood by one skilled in the art, the term mischmetal refers to a variety of known rare earth alloys. For example, two typical cerium mischmetals might have the following compositions (in weight %):

(1) Ce 45–60; other rare earths 35–50, the balance comprising Fe, Mg, Al, Si and impurities.

(2) Ce 52.7, other rare earths 47.5, Fe 0.04, Mg 0.28, Al 0.08, Si 0.27 and the balance impurities.

Typical Lanthanum mischmetals can be defined by the following (in weight %):

(1) La 60–90; Ce 8.5; Nd 6.5; Pr 2 the balance comprising Fe, Mg, Al and Si as well as possible impurities.

(2) La 83, Ce 8.5, Nd 6.5, Pr 2, Fe 0.2, Mg 0.03, Al 0.18, Si 0.43 and the balance impurities.

Thus the term mischmetal, as used herein, refers to the above compositions as well as other mischmetal compositions readily apparent to those skilled in the art.

As stated above, the preferred alloy to which mischmetal is to be added is a zinc-aluminum alloy containing from about 3% to about 15% aluminum. Such alloys typically contain about 5% aluminum. These alloys may contain constituents in addition to mischmetal such as Fe, Pb, Sb, Mg, Sn, Cu and Si.

Thus one embodiment of the invention comprises a low aluminum (i.e., 3–15%) zinc bath containing Pb or Sn as well as mischmetal. Pb and Sn are known additives to galvanizing baths for modifying the fluidity of the liquid metal or the spangle of the solidified coating.

The addition of Sb to a galvanizing bath is disclosed in U.S. Pat. No. 4,056,366 to improve the coatability of Zn-Al coatings in a manner similar to lead but without the deleterious effect that lead has upon the intergranular corrosion of the coatings. The addition of Sb to the mischmetal-containing compositions according to the present invention is therefore contemplated. Moreover, a Zn-Al composition containing Pb together with Sb is within the scope of the invention. A typical composition might contain 3–15% Al, 0.03–0.15% Sb, less than 0.02% Pb, and the balance Zn to which mischmetal has been added.

Zinc-aluminum alloys containing lead and also Mg and Cu are reported to be immune to grain boundary corrosion. In this type of coating alloys, mischmetal additions have been shown to exhibit a pronounced beneficial effect as regards soundness and uniformity. Thus a Zn-Al alloy containing Mg, Pb, Cu and mischmetal is encompassed by the present invention. Here a typical composition might contain 3–15% Al, 0.02–0.15% Mg, 0.02–0.15% Pb and possibly 0.1–0.3% Cu, the balance being Zn with mischmetal additions.

Various mischmetals may be advantageously used according to the invention, including mixtures of mischmetals in a single zinc bath or coating. For example, a La-mischmetal and a Ce-mischmetal may be added simultaneously, preferably in an amount such that the total mischmetal concentration is within the ranges described above, i.e. from about 5 ppm to about 1.0% and preferably from about 0.01 to 0.1% by weight.

In order to facilitate the addition of the mischmetal to the galvanizing bath, a master alloy may be first prepared and then added to the zinc bath so as to yield the desired mishmetal concentration. Such master alloys might be comprised of 20% Zn and 80% mischmetal or 85–95% Al and 15–5% mischmetal.

EXAMPLES

1. Specimens of rimming steel sheet measuring 68×120×0.7 mm were galvanized in a device simulating a continuous galvanizing bath. They were first preheated in an atmosphere containing 95% $N_2$-5% $H_2$ at different temperatures from 750° to 800° C. for times ranging from 1 to 10 minutes. After this heating stage the specimens were transferred from the hot zone of the furnace, cooled down to about 430° C. and then introduced into a zinc alloy bath maintained at 430° C. and protected by the 95% $N_2$-5% $H_2$ atmosphere. They were maintained in the zinc bath for periods ranging from 5 to 60 seconds and then removed from the bath and cooled in a jet of 95% $N_2$-5% $H_2$ gas.

Such tests were carried out with different types of bath compositions. The galvanized samples were examined to determine the soundness of the coating, particularly as regards the occurrence of bare spots and uncoated areas.

In a bath containing 5 to 8% Al without any other additions, the specimens contained a high proportion of uncoated areas and bare spots. This was the case even as to the specimens pretreated at the highest temperature and longest annealing time in the reducing atmosphere. The addition of 0.15% Sb in a Zn-5% Al bath resulted in a decrease in the amount of bare spots but still up to 33% of the galvanized faces presented bare spots.

A third bath containing 5% Al and 0.02% Ce added as Ce-mischmetal resulted in 100% good coatings for a range of heat treating conditions.

A bath containing Zn-5% Al, 0.03 La and 0.25 Ce added as La and Ce mischmetal gave rise to 100% good coatings even for preheating temperatures as low as 750° C.

2. This example relates to trials carried out with a pilot continuous annealing and galvanizing plant. In these trials 800 kg coils of rimming steel sheet 150 mm wide and 0.25 mm thick were first treated in a Selas type furnace at temperatures ranging from 680° to 860° C. The sheet was then cooled in a controlled atmosphere to about 430° C. and then introduced into a seven-ton zinc bath. The sheet was then nitrogen-gas wiped at the exit, jet cooled and finally coiled. Depending on test conditions the speed of the sheet varied in the range 10 to 30 m/min.

Several coils were galvanized with a bath containing Zn-5% Al and a cerium mischmetal content from 0.05%–0.001%. The cerium content varied from 0.04% to 0.0008% and the La content was 0.02% to 0.0002%. The resulting coating was bright with a grain size varying from 1 to 5 mm, depending on the cooling conditions, and with thicknesses varying from 5 to 35 μm depending on the gas wiping conditions. The coating was uniform and free of bare spots, uncoated areas or other defects.

A Zn-5% Al bath containing 0.13% Sn and as above 0.05% of cerium mischmetal was also used in the pilot galvanizing line. The coatings obtained had characteristics similar to those described above with a coating somewhat less bright due to a different spangle behavior. An additional bath containing Zn, 5% Al, 0.13% Sn, 0.05% Pb and about 0.05% Ce+La (added as Ce mischmetal or La mischmetal; or added as a master alloy containing about 20% Zn and 80% La and/or Ce mischmetals; or added as a master alloy containing about 90% Al and 10% La and/or Ce mischmetal) was also used in the pilot galvanizing line. The coatings obtained showed a wide range of thickness, were uniform and again were free of bare spots and uncoated areas.

It is evident that the pilot plant conditions are mentioned as examples only and that other conditions prevailing in continuous annealing and galvanizing lines as regards furnace type, composition of gas, speeds, wiping methods, etc., can be used with advantage with the zinc bath composition according to the invention. Moreover, bath and coating compositions as described herein may be used in non-continuous (e.g. batch) galvanizing methods.

3. Specimens from the above pilot plant trials were subjected to various trials for the evaluation of formability and adherence, the corrosion resistance in various environments, the galvanic protection, and the microstructure.

The formability and adherence was evaluated by means of bulge tests and Erichsen tests. In both types of tests the coatings obtained with the mischmetal-containing bath exhibited an adherence and formability equivalent to that of standard galvanized coatings. For example a 180° bending gave rise to no cracking and in the Erichsen test a depth of 9 mm was made on 0.25 mm thick sheets without peeling of the coating.

The corrosion resistance, in a salt spray test, of the Zn-Al coatings containing mischmetal was more than twice that of a standard galvanized coating of the same thickness. For example, with the coatings of the present invention the time to first rusting was about 900 hours instead of 350 hours with a conventional galvanized coating of the same thickness.

Similarly the corrosion resistance in an environment containing 10 ppm $SO_2$ was shown to be at least 50% greater than that of a conventional galvanized coating. The galvanic protection of the Zn-Al mischmetal coating was also determined by examining the progress of corrosion around scratches machined on specimens exposed to a $SO_2$-containing environment. The galvanic protection of the mischmetal-containing Zn-5% Al coating was equal to that of a pure zinc coating and far superior to that of a coating containing Zn-55Al-1.5Si.

We claim:

1. A protective metal coating adhered to a substrate, said coating comprising from about 85% to about 97% Zn, from about 4% to about 15% Al, and at least about 5 ppm of a rare earth-containing alloy.

2. A coating according to claim 1 wherein the rare earth-containing alloy is mischmetal.

3. A coating according to claim 2 containing from about 5 ppm to about 1.0% mischmetal.

4. A coating according to claim 3 containing from about 0.01 to about 0.1% mischmetal.

5. A coating according to claim 4 wherein the mischmetal is Ce-mischmetal or La-mischmetal.

6. A coating according to claim 4, said coating containing about 5% Al.

7. A coating according to claim 3 wherein the mischmetal is Ce-mischmetal or La-mischmetal.

8. A coating according to claim 7 wherein said mischmetal is a Ce-mischmetal comprising from about 45–60% Ce, from about 35 to 50% other rare earths, and the balance comprising Fe, Mg, Al, Si and impurities.

9. A coating according to claim 7 wherein said mischmetal is a Ce-mischmetal comprising about 52.7% Ce, other rare earths 47.5%, Fe 0.04%, Mg 0.28%, Al 0.08%, Si 0.27% and the balance impurities.

10. A coating according to claim 7 wherein said mischmetal is a La-mischmetal comprising about 60–90% La, 8.5% Ce, 6.5% Nd, 2% Pr, and the balance comprising Fe, Mg, Al and Si and impurities.

11. A coating according to claim 10 wherein said mischmetal comprises about 83% La, 8.5% Ce, 6.5% Nd, 2% Pr, 0.2% Fe, 0.03% Mg, 0.18% Al, 0.43% Si and the balance impurities.

12. A coating according to claim 3, said coating containing additionally at least one of the elements selected from the group consisting of Fe, Pb, Sb, Mg, Sn, Cu, and Si.

13. A coating according to claim 3, said coating containing additionally antimony.

14. A coating according to claim 13, said coating containing additionally lead.

15. A coating according to claim 14 containing from about 0.03–0.15% Sb and less than 0.02% Pb.

16. A coating according to claim 3, said coating containing additionally Mg and Pb.

17. A coating according to claim 16 containing from about 0.02–0.15% Mg and from about 0.02–0.15% Pb.

18. A coating according to claim 17, said coating containing additionally Cu.

19. A coating according to claim 18 containing from about 0.1–0.3% Cu.

20. A coating according to claim 3, said coating containing about 5% Al.

21. A coating according to claim 3 consisting essentially of about 5% Al, from about 5 ppm to about 0.1% mischmetal and the balance zinc.

22. A method of applying a protective metal coating to a substrate comprising the steps of immersing the substrate in a molten alloy comprised of zinc, aluminum and mischmetal, said bath formulated so as to yield a coating comprising from about 85% to about 97% Zn, from about 3% to about 15% Al, and at least about 5 ppm mischmetal.

23. A method according to claim 22 wherein said mischmetal is added to the alloy in the form of a master alloy.

24. A method according to claim 23 wherein said master alloy comprises 20% Zn and 80% mischmetal.

25. A method according to claim 23 wherein said master alloy comprises about 85–95% Al and about 5–15% mischmetal.

* * * * *

UNITED STATES PATENT AND TRADEMARK OFFICE

CERTIFICATE OF CORRECTION

PATENT NO. : 4,448,748

DATED : May 15, 1984

INVENTOR(S) : S. F. Radtke et al.

It is certified that error appears in the above-identified patent and that said Letters Patent are hereby corrected as shown below:

Column 4, line 63, "4%" should be --3%--.

Signed and Sealed this

*Seventh* Day of *January 1986*

[SEAL]

*Attest:*

DONALD J. QUIGG

*Attesting Officer*

*Commissioner of Patents and Trademarks*